US006126470A

United States Patent [19]

Ono

[11] Patent Number: 6,126,470

[45] **Date of Patent: *Oct. 3, 2000**

[54] CONNECTOR CONNECTING STRUCTURE

[75] Inventor: Junichi Ono, Nagoya, Japan

[73] Assignees: Harness System Technologies Research, Ltd.; Sumitomo Wiring Systems, Ltd.; Sumitomo Electric Industries, Ltd., all of Mie, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/968,323

[22] Filed: Nov. 12, 1997

[30] Foreign Application Priority Data

Nov. 13, 1996 [JP] Japan ..... 8-302177

[51] Int. Cl.[7] ..... H01R 13/62

[52] U.S. Cl. ..... 439/310; 439/372

[58] Field of Search ..... 439/310, 372, 439/152–160, 350–358, 347

[56] References Cited

U.S. PATENT DOCUMENTS

| | | | |
|---|---|---|---|
| 4,332,432 | 6/1982 | Colleran | 439/310 |
| 4,981,440 | 1/1991 | Werner et al. | 439/372 |
| 5,035,634 | 7/1991 | Hasircoglu et al. | 439/310 |
| 5,135,408 | 8/1992 | Suzuki | 439/310 |
| 5,244,400 | 9/1993 | Hatagishi | 439/157 |
| 5,252,089 | 10/1993 | Hatagishi et al. | 439/310 |
| 5,681,175 | 10/1997 | Busse et al. | 439/347 |

FOREIGN PATENT DOCUMENTS

| | | |
|---|---|---|
| 0 501 502 A2 | 9/1992 | European Pat. Off. . |
| 2385238 | 10/1978 | France . |
| 94 15 639 | 12/1994 | Germany . |
| 4-319271 | 11/1992 | Japan . |
| 5-114436 | 5/1993 | Japan . |

*Primary Examiner*—Hien Vu
*Attorney, Agent, or Firm*—Oliff & Berridge, PLC

[57] ABSTRACT

A first connector is temporarily maintained in a pre-connection position by a retention mechanism provided on a first connector and a holder, and when connecting the first connector and a second connector together, the first connector is released from the pre-connection position. A drive mechanism for moving the first connector to the pre-connection position when releasing the connection between the first and second connectors is provided on the first and second connectors. The second connector is provided with retaining portions that maintain a connection between the first connector and the second connector while the first connector is moved to the pre-connection position by the drive mechanism, and that allow the connection between the first connector and the second connector to be released when the first connector is moved to the pre-connection position.

9 Claims, 12 Drawing Sheets

CONNECTOR CONNECTING STRUCTURE

BACKGROUND OF THE INVENTION

1. Field of Invention

This invention relates to a connector connecting structure for electrically connecting first and second mating connectors together.

2. Description of Related Art

In order to improve the connectability of a multi-pole connector which has many terminals, and offers a large connecting resistance, there has been proposed a sliding connection-type electric connector (as disclosed in Japanese Patent Unexamined Publication No. 4-319271) comprising a holder (slide member) which supports a first connector inserted therein, and has a plurality of engagement projections formed on upper and lower wall surfaces thereof, a second connector of a generally rectangular shape which has a recess for receiving the holder, and openings generally parallel to side walls thereof, and an operating member of a generally U-shape having a cam groove for engagement with the engagement projection of the holder, and the first and second connectors are connected together by sliding the operating member.

More specifically, in the above sliding connection-type electric connector, the first connector is inserted and supported in the holder, and then a plate portion of the operating member is inserted into the opening formed in the side wall of the second connector, and the engagement projection of the holder, supported in the first connector, is positioned with respect to the cam groove in the operating member, and is engaged therein, and in this condition the operating member is pushed or moved in a longitudinal direction of the holder, so that the engagement projection of the holder is slidingly moved along the cam groove, thereby connecting the first connector, supported in the holder, to the second connector.

In the connector of the above structure, the second connector, with which the operating member is engaged, is provisionally engaged with the first connector supported in the holder, and the engagement projection, formed on the holder, is positioned with respect to the cam groove in the operating member, and then this operating member is pushed in the longitudinal direction of the holder so as to connect the first connector to the second connector. Thus, at least a two-stage operation must be carried out, and therefore there is encountered a problem that the connecting operation is cumbersome.

In order to simplify the connector connecting operation by omitting the above positioning operation, there may be proposed a structure in which the connector is retained at a pre-connection position where the engagement projection of the holder, supporting the first connector, is positioned with respect to the cam groove in the operating member engaged with the second connector, and when effecting the connector connecting operation, the two connectors are moved into the connecting position while forcibly releasing the first connector from the pre-connection position. With this structure, however, when the connectors are to be again connected together, the connector can not be returned to the pre-connection position, and therefore there is encountered a problem that the connector connecting operation can not be effected repeatedly.

SUMMARY OF THE INVENTION

In view of the above problems, it is an object of this invention to provide a connector connecting structure in which a connector connecting operation can be effected repeatedly.

According to the invention, there is provided a connector connection structure comprising a first connector supported on a holder, and a second connector for connecting to the first connector, wherein the first connector is temporarily maintained in a pre-connection position by a retention mechanism provided on the first connector and the holder, and when connecting the first and second connectors together, the pre-connection position of the first connector is released, so that the first connector can be slidingly shifted into a connection position; in that a drive mechanism for moving the first connector back to the pre-connection position when releasing the connection between the first and second connectors is provided on the first and second connectors; and the second connector is provided with a retaining portion which maintains the connection between the first connector and the second connector, achieved by the drive mechanism, before the first connector is moved to the pre-connection position by the drive mechanism, and also allows the connection between of the first connector and the second connector to be released when the first connector is moved to the pre-connection position.

With this structure, the first connector, supported by the holder, is temporarily maintained in the pre-connection position, and in this condition the first and second connectors are connected together. When releasing the connection between the two connectors, the drive mechanism, is maintained by the retaining portion during the time when the first connector is moved from the connection position to the pre-connection position by the drive mechanism, and therefore the first connector can be positively returned to the pre-connection position.

In the connector connection structure of the invention, there is provided a release mechanism which when connecting the first and second connectors together, drives the retention mechanism so as to forcibly release the first connector from the pre-connection position.

With this structure, when connecting the first and second connectors together, a retaining portion is forced into a release position by the release mechanism, and therefore the pre-connection position of the first connector, achieved by the retention mechanism, is positively released, so that the first connector is allowed to move into the connection position.

DETAILED DESCRIPTION OF PREFERRED EMBODIMENTS

Figure 1:
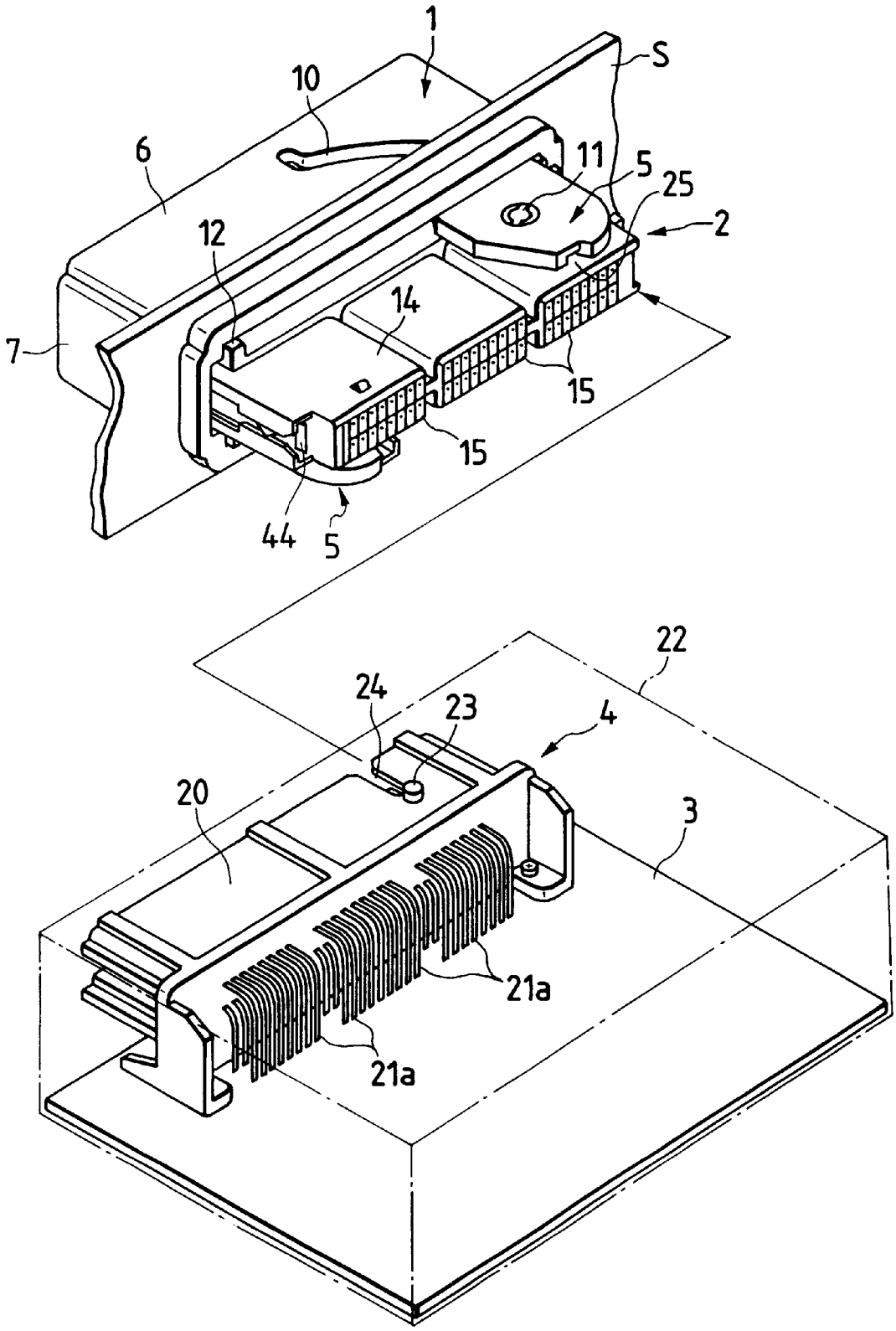
FIG. 1 is a perspective view of a preferred embodiment of a connector connection structure of the invention.

FIG. 1 shows a preferred embodiment of a connector connecting structure of the present invention. This connector comprises a holder 1 mounted on a mounting portion S, such as a stationary member in an automobile, a first connector 2 slidably supported by this holder 1, a second connector 4 mounted on a circuit board 3 of an electronic unit 22, and swingable or pivotal levers 5 for driving the second connector 4 in a direction to connect the same to the first connector 2.

Figure 2:
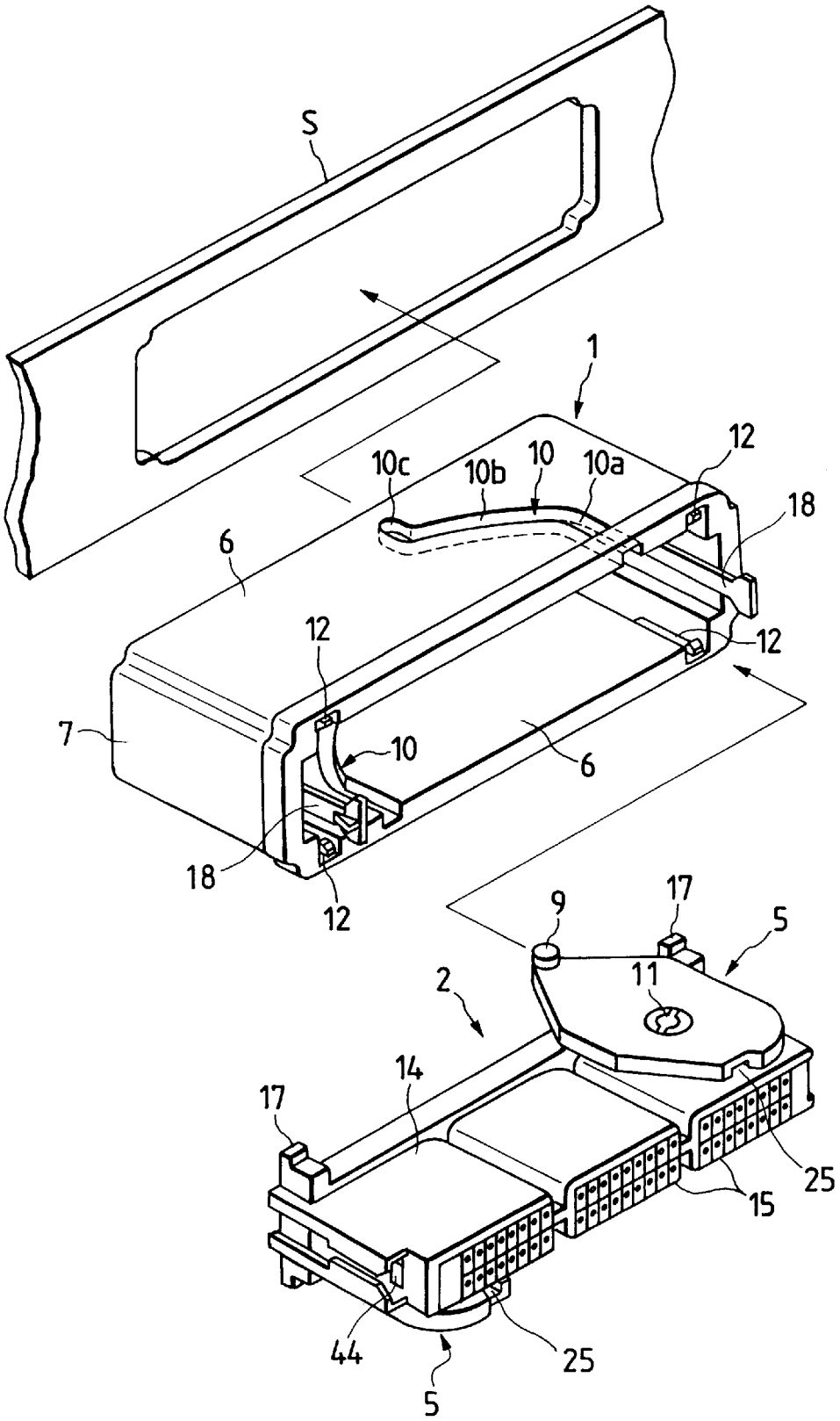
FIG. 2 is an exploded, perspective view showing the structure of a first connector.

As shown in FIG. 2, the holder 1 has a tubular shape, and comprises a pair of upper and lower horizontal plates 6, and a pair of right and left side plates 7, and the holder 1 is fitted into a mounting hole in the mounting portion S, and is fixed thereto by fastening means such as screws. A guide groove 10 is formed in each of the horizontal plates 6, and an engagement pin 9, formed on an outer surface of the swingable lever 5 at a rear end thereof, is engageable in the guide groove 10. This guide groove 10 has an introduction portion 10*a* extending rearwardly from the front side of the holder 1, a drive groove portion 10*b* of an arcuate shape extending rearwardly inwardly from a rear end of the introduction portion 10*a*, and a retaining groove portion 10*c* extending rearwardly from a rear end of the drive groove portion 10*b*. The drive groove portion 10*b* of the guide groove 10 and the engagement pin 9 cooperate with each other to provide a drive portion which swingingly displaces the swingable lever 5 in accordance with a sliding displacement of the first connector 2 as described later.

In this embodiment, although the drive groove portion 10*b* of the guide groove 10 has an arcuate shape, this drive groove portion, formed in the holder 1, may linearly extend rearwardly inwardly from the rear end of the introduction portion 10*b*, or may extend in a curved (e.g. parabolic) manner.

The guide groove 10, formed in the upper horizontal plate 6, and the guide groove 10, formed in the lower horizontal plate 6, are arranged in a point-symmetrical manner (that is, symmetrically with respect to a point), and the swingable lever 5, mounted on the upper side of the first connector 2, and the swingable lever 5, mounted on the lower side of the first connector 2, are swingingly displaceable in opposite directions, respectively. More specifically, when viewed from the front side of the holder 1, the guide groove 10, formed in the upper horizontal plate 6, is provided at the right side thereof, and the drive groove portion 10*b* extends left obliquely. When viewed from the front side of the holder 1, the guide groove 10, formed in the lower horizontal plate 6, is provided at the left side thereof, and the drive groove portion 10*b* extends right obliquely. Thus, the two drive groove portions 10*b* are arranged reversely.

Figure 3:
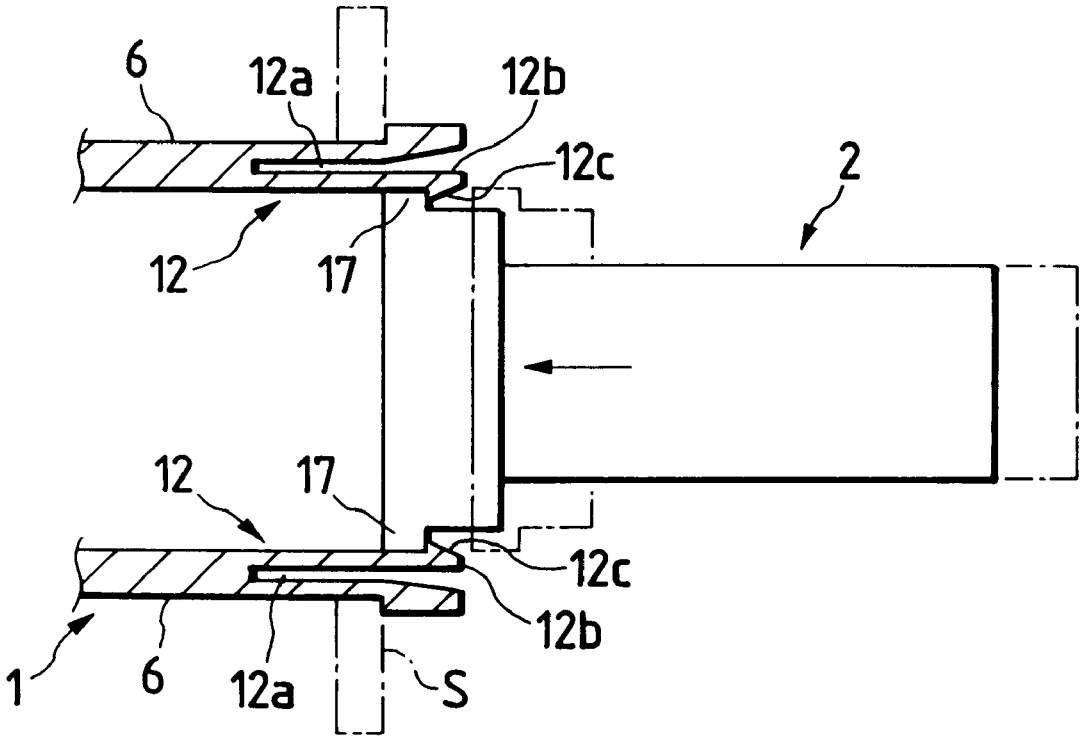
FIG. 3 is a side-elevational, cross-sectional view showing a condition in which the first connector is temporarily maintained in a pre-connection position on a holder by retaining portions.

As shown in FIG. 3, a pair of slits 12*a* with a predetermined portion accordance width are formed respectively in right and left end portions of each of the horizontal plates 6 of the holder 1 to provide retaining portions 12 for temporarily maintaining the first connector 2 in a pre-connection position. A retaining step portion 12*b* facing a projection 17, formed on the rear end of the first connector 2, is formed at a distal end of the retaining portion 12.

A front surface of each projection 17 on the first connector 2 abuts against a rear surface of the retaining step portion 12*b* formed on the associated retaining portion 12 of the holder 1, thereby preventing the first connector 2 from being withdrawn forwardly. The retaining step portion 12*b* has a slanting (tapering) surface 12*c*, and has a tapering configuration.

The first connector 2 comprises a male connector housing 14 which is inserted and slidably held in the holder 1, and a plurality of female terminals 15 mounted respectively in terminal receiving chambers in the connector housing 14. The projections 17 for retaining engagement with the respective retaining step portions 12*b* are formed respectively at the upper, lower, right and left surfaces of the rear end of the connector housing 14.

Figure 4:
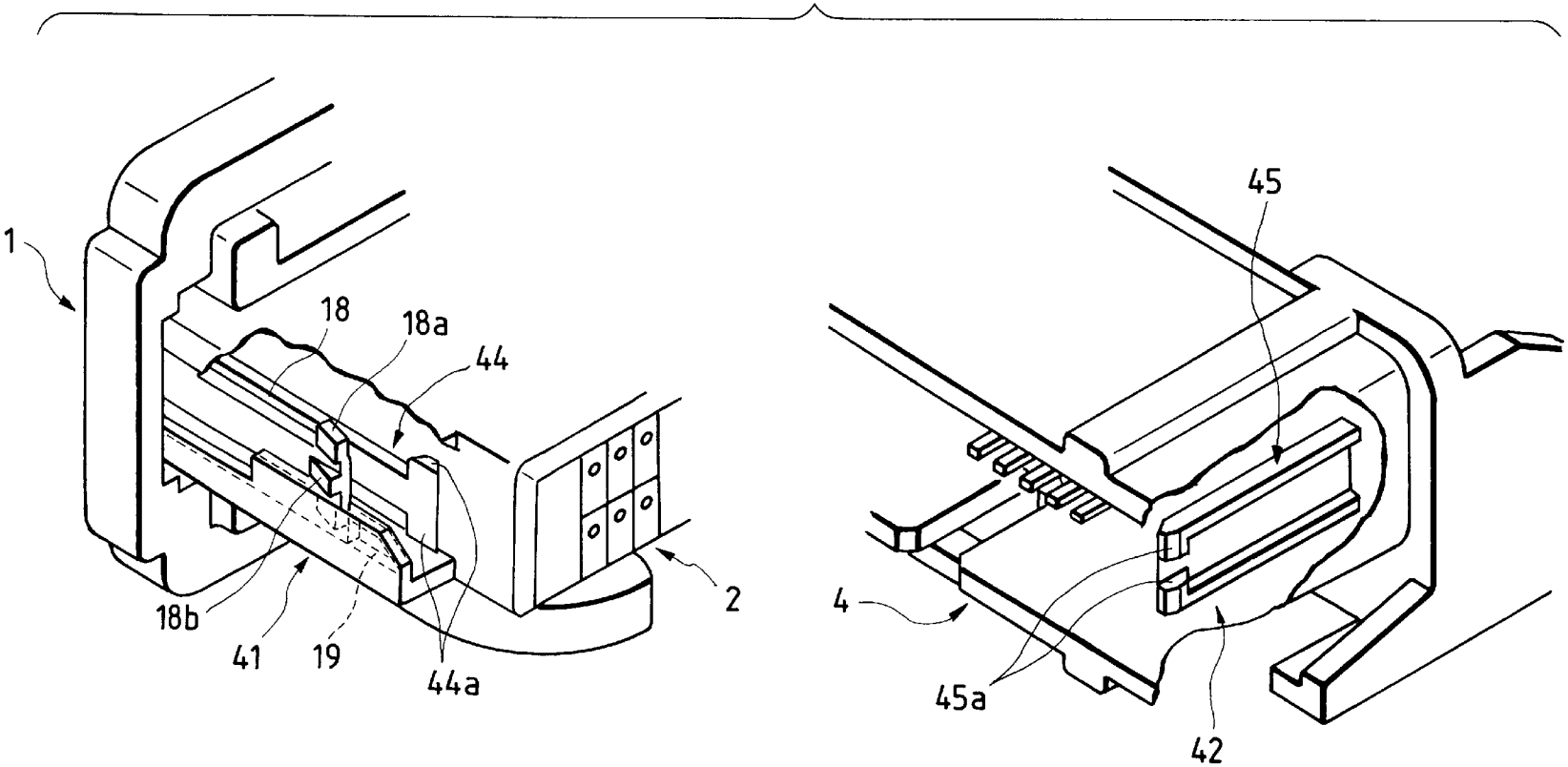
FIG. 4 is a perspective view of a portion of the connector connection structure.
Figure 5:
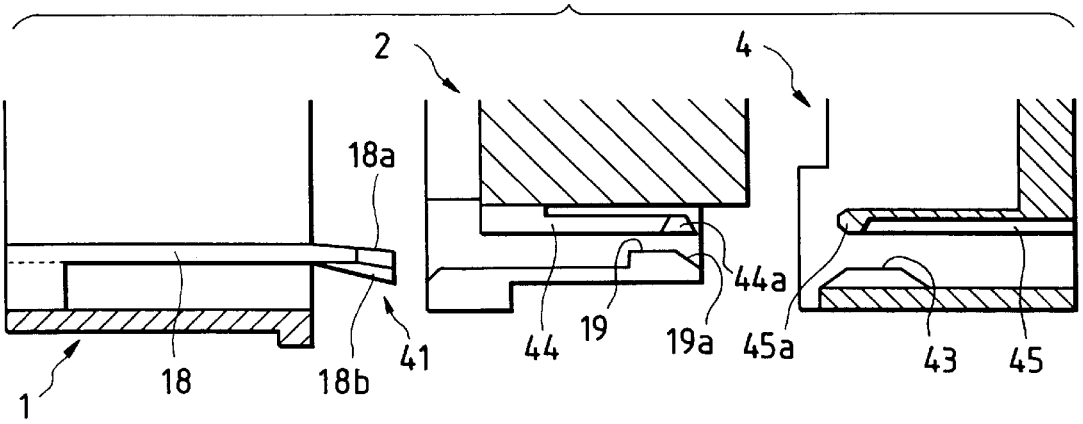
FIG. 5 is a cross-sectional view of a portion of the connector connection structure.

As shown in FIGS. 4 and 5, provided on the holder 1 and the first connector 2 is a retention mechanism 41 which temporarily maintains the first connector 2 in the pre-connection position so as to prevent the first connector 2 from being forced into the holder 1 before a connection operation (described later) is effected. Provided on the first connector 2 and the second connector 4 is a drive mechanism 42 which moves the first connector 2 into the pre-connection position when the connection between the first and second connectors 2 and 4 is to be released. Retaining portions 43 for retaining the drive mechanism 42 in a driven condition are provided at the second connector 4.

Figure 6:
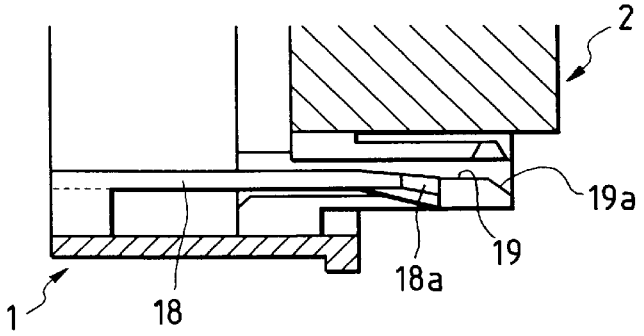
FIG. 6 is a cross-sectional view showing a condition in which the first connector is temporarily maintained in a pre-connection position.

The retention mechanism 41 comprises a retaining arm 18 projecting forwardly from a rear end portion of the side wall of the holder 1, and a step portion 19 formed on an inner surface of a side wall of the connector housing 14 of the first connector 2. A pair of upper and lower projections 18*a* are formed at a distal end of the retaining arm 18, and abut against a rear end surface of the step portion 19 to temporarily maintain the first connector 2 in the pre-connection position, as shown in FIG. 6. A tapering (inwardly slanting) surface 19*a* is formed at the step portion 19 of the connector housing 14, and when releasing the connection, the tapering surface 19*a* abuts against a rear end of the projection 18*a* to swingingly displace the retaining arm 18 inwardly.

A triangular projection 18*b*, having a tapering (outwardly slanting) surface, is formed at the distal end of the retaining arm 18, and is disposed between the two projections 18*a*, and this projection 18*b* and the retaining portion 43, formed on an inner surface of a side wall of a connector housing 20 of the second connector 4, jointly constitute a release mechanism which when releasing the connection between the first and second connectors 2 and 4, swingingly displaces the distal end portion of the retaining arm 18 inwardly, thereby releasing the pre-connection position of the first connector 2 achieved by the retention mechanism 41.

Figure 7:
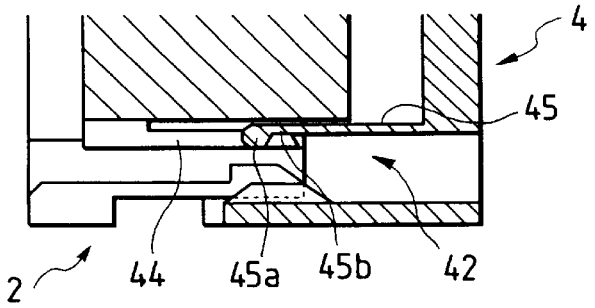
FIG. 7 is a cross-sectional view showing the structure of a drive mechanism.

The drive mechanism 42 comprises a first engagement arm 44, extending forwardly from the rear end portion of the first connector 2, and a second engagement arm 45 extending forwardly from the rear end portion of the second connector 4, and an engagement projection 44*a* formed at a distal end of the first engagement arm 44, and an engagement projection 45*a* for engagement with the engagement projection 44*a* formed at a distal end of the second engagement arm 45. As shown in FIG. 7, when the second connector 4 is pulled in a connection release direction, with the two engagement projections 44*a* and 45*a* engaged with each other, the first connector 2 is moved from the connection position (i.e., a rear position in the holder 1) to the pre-connection position.

The two engagement projections 44*a* and 45*a* have respective pairs of slanting (tapering) surfaces which swingingly displace the distal end portion of the first engagement arm 44 outwardly to bring the engagement projections 44*a* and 45*a* into engagement with each other when connecting the two connectors 2 and 4 together, and swingingly displace the distal end portion of the first engagement arm 45 to release the engagement between the engagement projections 44*a* and 45*a* when releasing the connection between the connectors 2 and 4.

Figure 8:
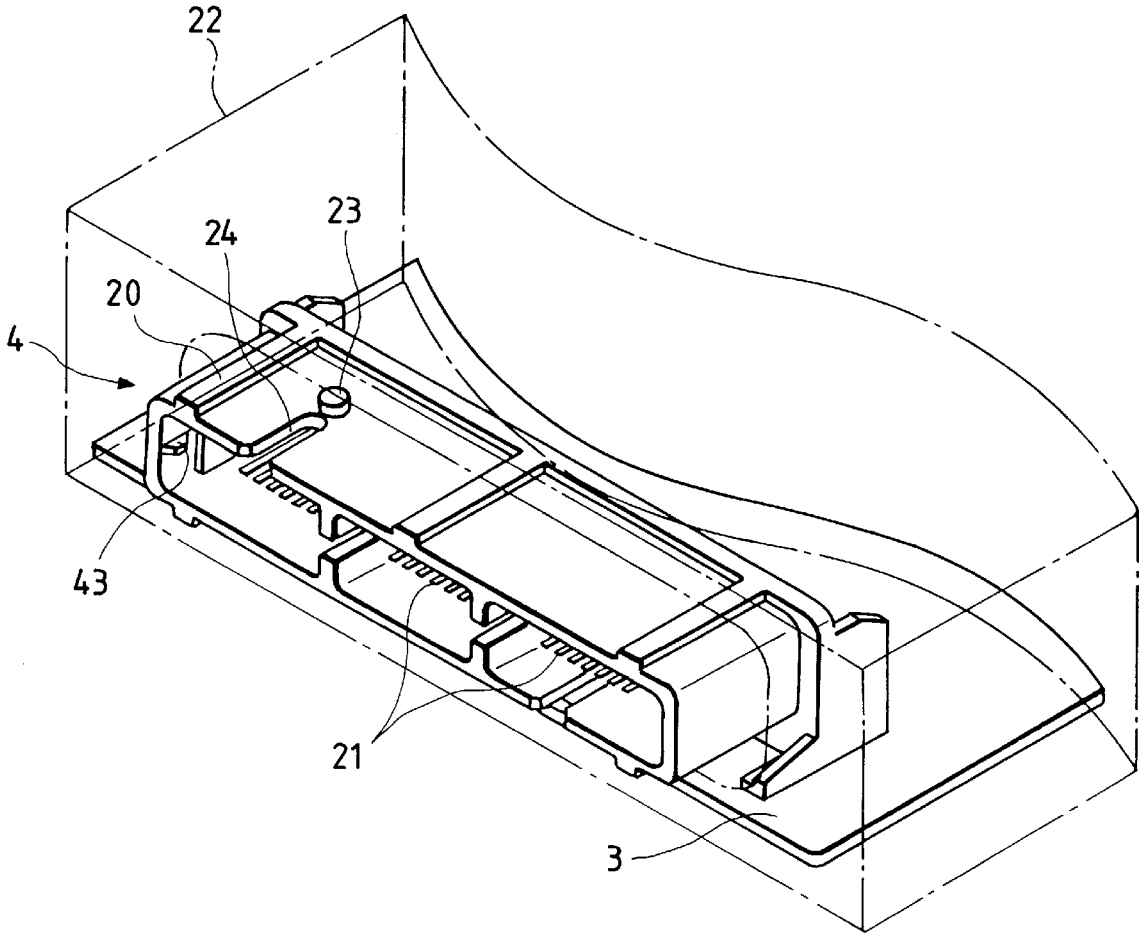
FIG. 8 is a perspective view showing the structure of a second connector.

As shown in FIG. 8, the second connector 4 comprises the female connector housing 20 for fitting on the connector housing 14 of the first connector 2, and a plurality of male terminals 21 mounted in terminal receiving chambers in the connector housing 20. The connector housing 20 is fixedly secured to the circuit board 3 by screws or the like, and connection portions 21 a of the male terminals 21 extend outwardly from the rear side of the connector housing 20, and are connected by soldering or the like to conductor portions on the circuit board 3 (see FIG. 1). The second connector 4 and the circuit board 3 are mounted within a casing of the electronic unit 22. A pair of driven pins 23 are formed respectively on upper and lower walls of the connector housing 20, and are driven by the swingable levers 5, respectively, and a pair of slits 24 are formed respectively in these upper and lower walls in such a manner that the two slits 24 can be disposed in registry with swing pivots 11 of the swingable levers 5, respectively.

Figure 9:
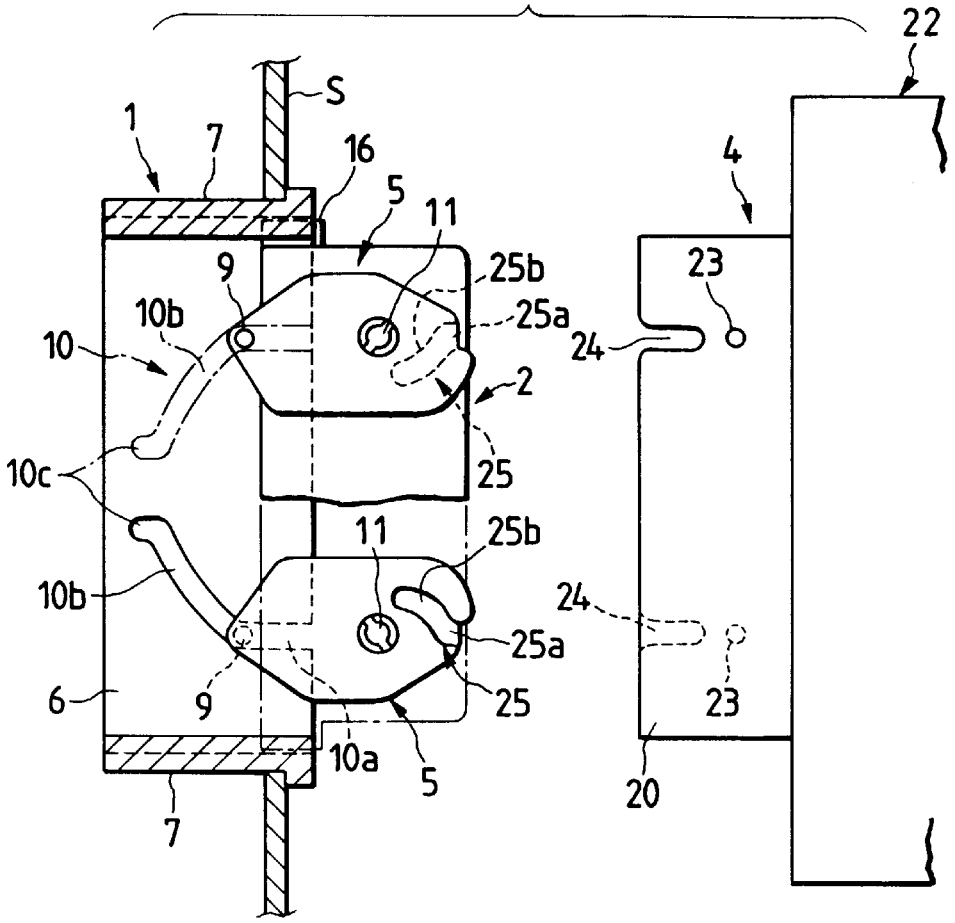
FIG. 9 is a horizontal cross-sectional view showing a condition before the first and second connector are connected together.

As shown in FIG. 9, the swingable levers 5 are swingably supported on the connector housing 14 of the first connector 2 by the respective swing pivots 11 (each comprising a support pin or the like) in such a manner that the swingable levers 5 can be disposed respectively in registry with the guide grooves 10 formed in the holder 1. The engagement pin 9 is formed on the outer surface of each swingable lever 5 (that is, the upper surface of the upper swingable lever 5, and the lower surface of the lower swingable lever 5) at the rear end thereof, and can be fitted in the guide groove 10. An engagement groove 25 is formed in the reverse (inner) surface of each swingable lever 5 (that is, the lower surface of the upper swingable lever 5, and the upper surface of the lower swingable lever 5) at a front end portion thereof, and the driven pins 23, formed on the connector housing 20 of the second connector 4, are engageable in the engagement grooves 25, respectively.

The engagement groove 25 in the swingable lever 5 has an opening portion 25*a* serving as an introduction portion for the driven pin 23, and an operating groove portion 25*b* continuously extending rearwardly from the opening portion 25*a* toward the inner side of the swingable lever 5. The distance from the operating groove portion 25*b* to the swing pivot 11 is decreasing progressively from its front end toward its rear end, and with this arrangement the operating groove portion 25*b* and the driven pin 23 of the second connector 4 cooperate with each other to provide an operating portion which transmits a driving force, inputted to the swingable lever 5 from the above-mentioned drive portion, to the second connector 4, thereby moving the second connector 4 in a direction to connect the same to the first connector 2.

More specifically, the distance from the operating groove portion 25*b* to the swing pivot 11 is so determined that the operating groove portion 25*b* approaches the swing pivot 11 progressively from its front end toward its rear end, and with this arrangement when the first and second connectors 2 and 4 are to be connected together, the first connector 2 is forced or pushed into the holder 1 to be slidingly displaced, and in accordance with this sliding displacement of the first connector 2, each driven pin 23 is drawn toward the associated swing pivot 11, thereby moving the second connector 4 toward the first connector 2.

The position of the drive groove portion 10*b* of each guide groove 10 relative to the associated swing pivot 11, the position of the operating groove portion 25*b* of each engagement groove 25 relative to the associated swing pivot 11, and their configurations are so determined that the amount of movement of the second connector 4 in the above connecting direction is smaller than the amount of pushing of the first connector 2 into the holder 1. With this arrangement, the driving force, inputted to the swingable lever 5 from the drive portion, is increased, and is transmitted to the driven pin 23 of the second connector 4 from the operating groove portion 25*b*.

For connecting the first connector 2 of the above structure and the second connector 4 of the above structure together, the first connector 2, having the female terminals 15 mounted in the male connector housing 14, is opposed to the front opening in the holder 1 as shown in phantom in FIG. 3, and then the connector housing 14 is pushed in a direction of an arrow to be inserted into the holder 1, thereby setting the first connector 2 in the connection stand-by position as indicated in solid lines in FIG. 3.

More specifically, in accordance with the insertion of the first connector 2 into the holder 1, the projections 17 of the connector housing 14 are pressed respectively against the slanting surfaces 12*c* of the retaining portions 12 formed on the horizontal plates 6 of the holder 1, and elastically deform these retaining portions 12. Then, when the projections 17 pass respectively past the retaining step portions 12*b* of the retaining portions 12, and are received in the holder 1, and the rear ends of the step portions 19, formed respectively on the inner surfaces of the side walls of the first connector 2, are abutted respectively against the front surfaces of the projections 18*a* of the retaining arms 18 formed on the holder 1 as shown in FIG. 6, and in this condition the first connector 2 is temporarily maintained in the pre-connection position.

When the first connector 2 is thus inserted, the engagement pins 9, formed respectively at the rear ends of the swingable levers 5, are introduced respectively into the guide grooves 10 in the holder 1, and the engagement pins 9 are disposed respectively at the rear end portions of the introduction portions 10*a* of the guide grooves 10.

Then, the holder 1 is fixedly secured to the mounting portion S of a vehicle body, and then the electronic unit 22, having the second connector 4 mounted thereon, is opposed to the first connector 2, and is pushed, so that the connector housing 20 of the second connector 4 is fitted on the connector housing 14 of the first connector 2, thereby electrically connecting the first connector 2 and the second connector 4 together.

Figure 10:
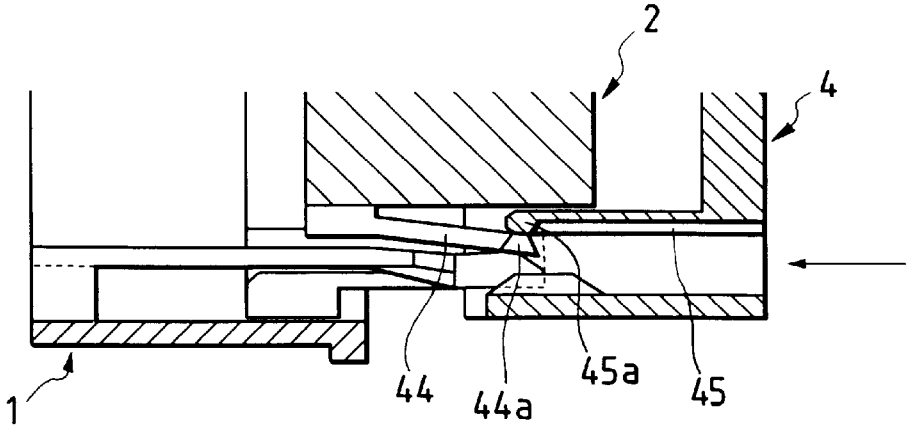
FIG. 10 is a cross-sectional view showing a first connector connection step.
Figure 11:
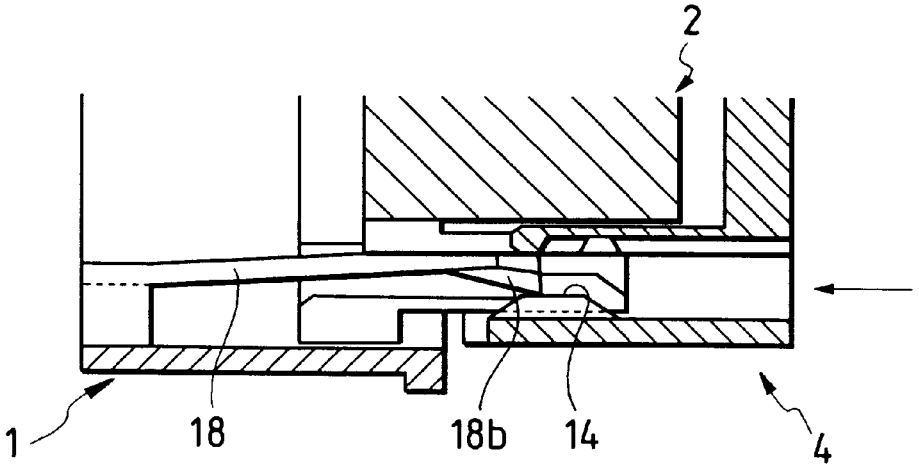
FIG. 11 is a cross-sectional view showing a second connector connection step.

In accordance with the connection of the second connector 4 to the first connector 2, the engagement projection 45*a* of each second engagement arm 45, formed on the second connector 4, enters the holder 1 toward the rear side thereof while displacing the engagement projection 44 of the second engagement arm 44 outwardly, so that the two engagement projections can be engageable with each other, as shown in FIG. 10. Further, when the projection 18*b* of the retaining arm 18 is inwardly displaced by the retaining portion 43 of the second connector 43, the pre-connection position of the first connector 2, achieved by the retention mechanism 41, is forcibly released, so that the first connector 2 can be slidingly displaced to the connection position, as shown in FIG. 11.

Figure 12:
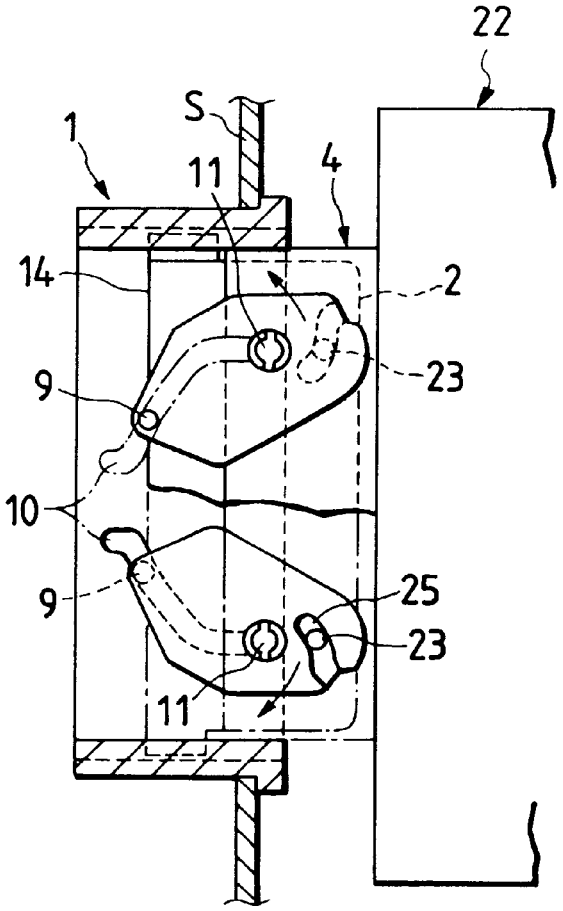
FIG. 12 is a horizontal cross-sectional view showing a third connector connection step.

Then, when the first connector 2 is pushed rearwardly by the second connector 4, the first connector 2 is slidingly displaced rearwardly along support portions of the holder, and also the driven pins 23 of the second connector 4 are introduced respectively into the engagement grooves 25 of the swingable levers 5, and thus are engaged with the swingable levers 5, respectively, as shown in FIG. 12.

In this condition, when the second connector 4 is further pushed to slidingly displace the first connector 2 rearwardly, the engagement pins 9 of the swingable levers 5, supported on the first connector 2, slide respectively along the drive groove portions 10*b* of the guide grooves 10, so that the rear end portions of the swingable levers 5 move inwardly toward the rear end of the holder 1, and as a result the swingable levers 5 are swingingly displaced about the respective swing pivots 11. In accordance with the swinging displacement of each swingable lever 5, the associated driven pin 23 on the second connector 4 slides along the operating groove portion 25*b* formed in the front end portion of the swingable lever 5, so that the driven pin 23 is drawn toward the swing pivot 11, and the second connector 4 is moved toward the first connector 2.

The amount of movement of the second connector 4 driven by the swingable levers 5 in the connecting direction is smaller than the amount of displacement of the first connector 2 which swingingly displaces the swingable levers 5, and therefore the driving force, inputted to each swingable lever 5 from the drive portion, is increased, and is transmitted to the associated driven pin 23 from the operating groove portion 25*b*. As a result, in accordance with the driving forces inputted respectively to the driven pins 23 from the drive groove portions 25*b* of the swingable levers 5 in accordance with the sliding displacement of the first connector 2, the second connector 4 is pushed toward the first connector 2 with a large force, so that the first connector 2 and the second connector 4 are positively connected together.

Figure 13:
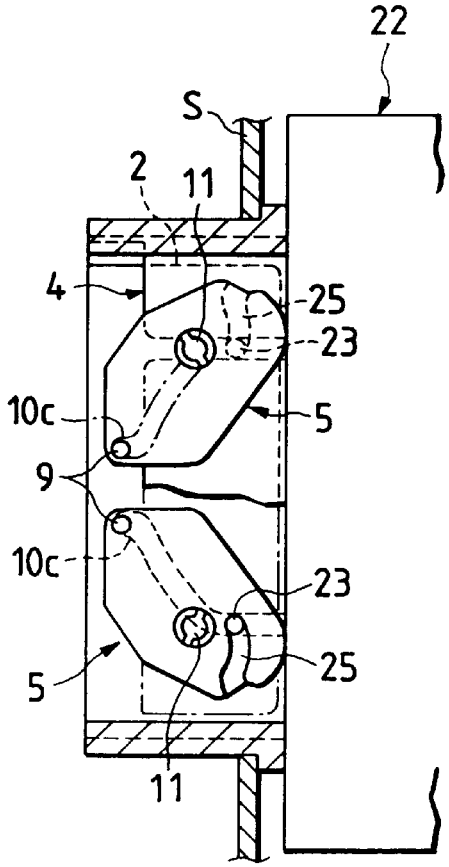
FIG. 13 is a horizontal cross-sectional view showing a connected condition of the connectors.

Then, at the final stage of the connection of the second connector 4 to the first connector 2, the engagement pin 9 of each swingable lever 5 is introduced into the retaining groove portion 10*c* of the associated guide groove 10, and moves straight toward the rear end of the holder 1 as shown in FIG. 13, so that the first connector 2 and the second connector 4 are slidingly displaced in unison along the support portions of the holder 1, without swingingly displacing the swingable levers 5.

For releasing the connection between the first connector 2 and the second connector 4, the electronic unit 22 is pulled to slidingly displace the second connector 4 into the connection release position, so that the swingable levers 5 are swingingly displaced in directions opposite to the swinging directions during the connecting operation, and the swingable levers 5 and the first connector 2 are slidingly displaced forwardly, and then the two connectors 2 and 4 are disconnected from each other.

Figure 14:
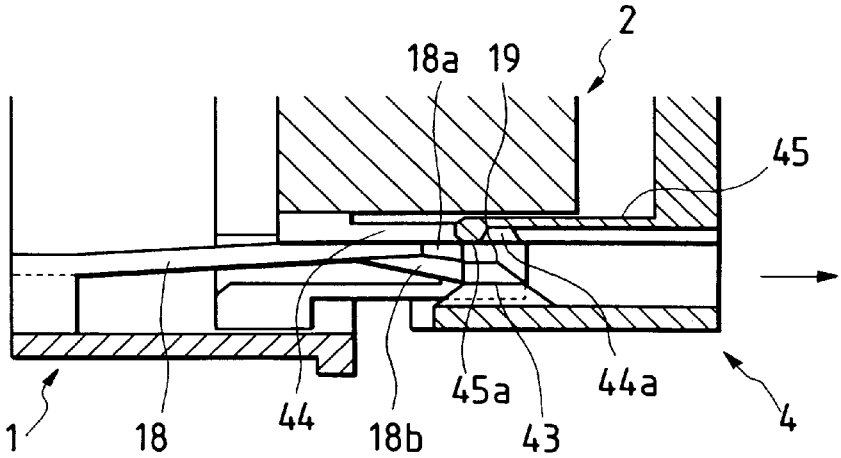
FIG. 14 is a cross-sectional view showing a first connector connection release step.

Namely, when the second connector 4 is pulled rearwardly, the first connector 2 is moved to the front side of the holder 1, with the engagement projection 44*a* of each first engagement lever 44 engaged with the engagement projection 45*a* of the associated second engagement lever 45, as shown in FIG. 14. Then, in accordance with the sliding movement of the second connector 4, the retaining portion 43, formed on the inner side of the side wall thereof, abuts against the projection 18*b* of the retaining arm 18 to push this projection 18*b* inwardly, thereby swingingly displacing the distal end portion of the retaining arm 18 inwardly.

As a result, the step portion 19 of the first connector 2 is allowed to slide over the projection 18*a* of the retaining arm 18, so that the first connector 1 can be slidingly displaced to the front side of the holder 1. Before the step portion 19 of the first connector 2 passes past the projection 18*a* of the retaining arm 18, and is moved to the pre-connection position, the distal end portion of the retaining arm 18 is held in an inwardly-pushed condition by the retaining portion 43 of the second connector 4, and therefore the swinging displacement of the first engagement arm 44 is inhibited by the retaining arm 18, and the two engagement projections 44*a* and 45*a* are kept engaged with each other, thus preventing the first and second connectors 2 and 4 from being disengaged from each other.

Figure 15:
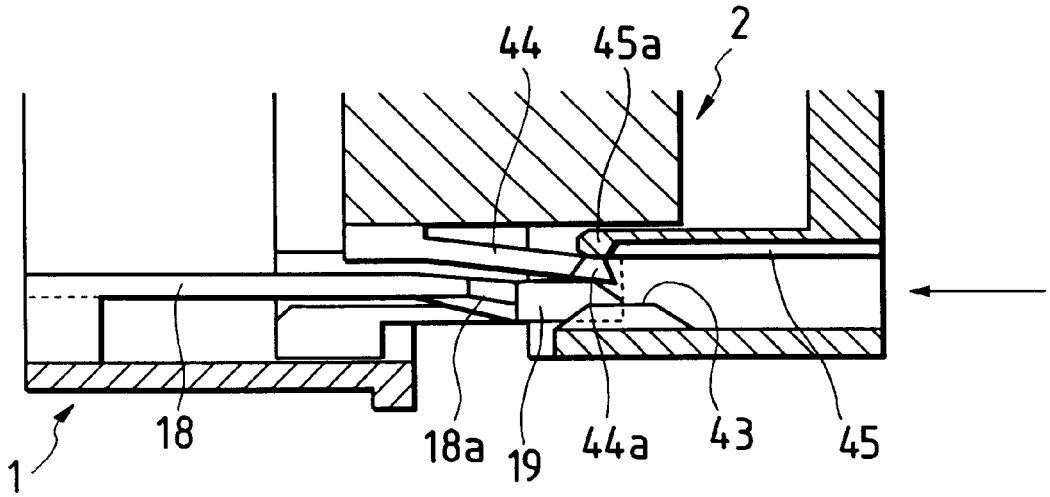
FIG. 15 is a cross-sectional view showing a second connector connection release step.

Then, as shown in FIG. 15, when the step portion 19 of the first connector 2 passes over the projection 18*a* of the retaining arm 18, and is drawn to the pre-connection position, the inward pushing of the retaining arm 18 by the retaining portion 43 of the second connector 4 is released, and also the inhibition of the swinging displacement of the first engagement arm 44 by the retaining arm 18 is released, and therefore the engagement between the two engagement projections 44*a* and 45*a* is released in accordance with the force to pull the first connector 2. Namely, the connection between the first connector 2 and the second connector 4, achieved by the drive mechanism 42, is released, so that the second connector 4 can be disconnected from the first connector 2.

As described above, the first connector 2 is temporarily maintained in the pre-connection position by the retention mechanism 41 comprising the retaining arm 18 of the holder 1 and the step portion 19 of the first connector 2, and this pre-connection position is released when the first and second connectors 2 and 4 are to be connected together. In this connector connecting structure, the drive mechanism 42, which moves the first connector 2 to the pre-connection position when releasing the connection between the first and second connectors 2 and 4, is provided on the first and second connectors 2 and 4, and therefore when releasing the connection between the first and second connectors 2 and 4 by pulling the second connector 4 connected to the first connector 2, the first connector 2 can be slidingly displaced to the front side of the holder 1 by the drive mechanisms 42 comprising the first engagement arm 44 and the second engagement arm 45, and the first connector 2 can be automatically returned to the pre-connection position.

The second connector 2 is provided with the retaining portions 43 which maintain the connection between the first connector 2 and the second connector 4, achieved by the drive mechanism 42, before the first connector 2 is moved to the pre-connection position by the drive mechanism 42, and also allow the connection between the first connector 2 and the second connector to be released when the first connector 2 is moved to the pre-connection position. Therefore, even if an external force, limiting the movement of the first connector 2, is applied during the time when the first connector 2 is moved toward the front side of the holder 1, and is moved to the pre-connection position by the drive mechanism 42, the retaining portions 43 prevent the disengagement of the second connector 4 before the first connector 2 is returned to the pre-connection position, and when releasing the connection between the two connectors 2 and 4, the first connector 2 can be positively moved to the pre-connection position by the drive mechanism 42.

Therefore, in the connector having the swingable levers 5, when the two connectors 2 and 4, once disconnected from each other, are to be again connected together, each swingable lever 5 can be set in the initial position where the open portion 25*a* of the engagement groove 25 in the swingable lever 5 is opposed to the driven pin 23 formed on the second connector 4, and therefore by the use of these swingable levers 5, the first and second connectors 2 and 4 can be positively moved to the connection position. The step portion 19 of the first connector 2 may serve as a retaining portion, in which case by this step portion 19, the retaining arm 18 is held in a position to inhibit the swinging movement of the first engagement arm 44, thereby maintaining the connection between first connector 2 and the second connector 4 achieved by the drive mechanism 42.

In the above embodiment, there is provided a release mechanism comprising the projection 18*a* of the retaining arm 18 and the retaining portion 43 of the second connector 4, and when connecting the first and second connectors 2 and 4 together, the retention mechanism 41 is driven by the release mechanism, thereby forcibly releasing the pre-connection position of the first connector 2. Therefore, before the two connectors 2 and 4 are connected together, the first connector 2 can be temporarily maintained in the pre-connection position by the retention mechanism 41, and also when connecting the two connectors 2 and 4 together, the pre-connection position of the first connector 2 can be easily and positively released by the release mechanism, so that the first connector 2 can be slidingly displaced along the holder 1, thereby shifting the two connectors 2 and 4 into the connected condition.

The provision of the retention mechanism may be omitted, in which case for example, each retaining arm 18 is elastically deformed in accordance with the pushing force, applied from the second connector 4 to the first connector 2, thereby releasing the pre-connection position achieved by the retention mechanism. In this case, however, there are encountered problems that the pre-connection position of the first connector 2 is unstable, and that the retaining arm 18 is liable to be damaged. Therefore, it is preferred to provide the retention mechanism comprising the projection 18*b* of the retaining arm 18 and the retaining portion 43 of the second connector 4.

In the above embodiment, the first connector 2 is supported by the holder 1, mounted on the mounting portion S, for sliding movement in its connecting direction, and the swingable levers 5 are swingingly displaceable in accordance with the sliding displacement of the first connector 2, and the driving force is increased in accordance with the swinging displacement of the swingable levers 5, and is transmitted to the second connector 4, thereby driving the second connector 4 in the direction to connect the same to the first connector 2. With this structure, by the simple operation, that is, merely by pushing the second connector 4 relative to the first connector 2 in the direction to connect the same thereto, a large connecting force can be imparted to the two connectors 2 and 4.

Therefore, even in the multi-pole connector which includes many female terminals 15, mounted in the first connector 2, and many male terminals 21 mounted in the second connector 4, and requires a large connecting force, the two connectors 2 and 4 can be positively shifted into the connected condition with one touch. And besides, the second connector 4 is mounted on the reverse side of the electronic unit 22, such as a meter unit, an air-conditioning unit and a navigation unit of the automobile, and the first connector 2 is mounted on the bottom of the mounting hole in which the electronic unit 22 is mounted. Therefore, even when the hand of the operator can not be inserted into the connecting portion of the two connectors 2 and 4, the two connectors 2 and 4 can be connected together easily and positively.

In the above embodiment, each swingable lever 5 is provided between the inner surface of the holder 1 and the outer surface of the first connector 2 which face each other, and therefore the swingable levers 5 do not project beyond the connector-mounting portion, thus preventing the formation of any dead space, but are allowed to be swingingly displaced. And besides, the swingable lever 5 has a plate-like configuration, and has a small thickness, and this prevents the vertical dimension of the connector from being increased.

In the above embodiment, the swingable levers 5 are provided in adjacent, facing relation to the upper and lower inner surfaces of the holder 1, respectively, and are disposed in a point-symmetrical manner. Therefore, with the simple structure, the uniform connecting forces can be applied to the various portions of the two connectors 2 and 4, so that the two connectors can be properly connected together. More specifically, where the width of the connector is large, the swingable levers 5 are provided respectively at the opposite side portions thereof, and the connecting forces can be caused to act respectively on the opposite side portions on the diagonal line of the connector, and this effectively prevents the improper connection which would otherwise result from the localized application of the connecting force to one side portion of the second connector 4.

In the above embodiment, the swingable levers 5, provided in adjacent, facing relation to the upper and lower inner surfaces of the holder 1, are swingingly displaceable in the opposite directions, respectively, and therefore the driving forces, transmitted respectively from the two swingable levers 5 to the second connector 4, are exerted in the opposite directions, respectively, as indicated by arrows in FIG. 12, and therefore the widthwise components of the drive forces, transmitted respectively from the two swingable levers 5 to the second connector 4, cancel each other. Therefore, in accordance with these driving forces, the second connector 4 can be slidingly displaced straight along the holder 1, and can be properly connected to the first connector 2.

In the above embodiment, at least one pair of swingable levers 5 of the same configuration are provided in adjacent, facing relation to the opposed surfaces of the holder 1, and the opposed swingable levers 5 are disposed in an inverted manner with respect to their opposite sides. Therefore, the number of the component parts can be reduced, and the productivity can be enhanced, and further the directions of swinging motion of the two swingable levers 5 can be opposite, so that the second connector 4 can be slidingly displaced straight as described above.

Instead of the above structure, there may be provided a structure in which the swingable lever 5 is provided on only one of the upper and lower sides of the first connector 2, or there may be provided a structure in which a pair of right and left swingable levers 5 are provided on each of the upper and lower sides of the first connector 2. Where the pair of swingable levers 5 are provided on each side, the directions of swinging motion of these levers do not always need to be opposite, but the two swingable levers 5 may be swingingly displaceable in the same direction.

In the above embodiment, the retaining portions 12 for preventing the first connector 2 from being withdrawn forwardly are formed on the horizontal plates 6 of the holder 1, and the projections 17, corresponding respectively to the retaining step portions 12*b* of the retaining portions 12, are formed on the connector housing 14 of the first connector 2, as shown in FIG. 3. Therefore, by abutting the projections 17 respectively against the retaining step portions 12*b*, the holder 1 and the first connector 2 can be kept in the connected position.

The retaining step portion 12 has the slanting surface 12*c* formed at its inner surface, and has the tapering configuration, and the slit 12*a* is provided between the horizontal plate 6 of the holder 1 and each retaining portion 12, and each projection 17 on the connector housing 14 can be pressed against the slanting surface 12*c* of the associated retaining step portion 12*b* to elastically deform the retaining portion 12. In this case, the connection of the first connector 2 to the holder 1 can be easily effected with one touch. By elastically deforming the retaining portions 12, the first connector 2 can be withdrawn outwardly from the holder 1.

As described above, each guide groove 10, formed in the holder 1, has the retaining groove portion 10*c* at its rear end portion, and the engagement pins 9, introduced respectively into the retaining groove portions 10*c*, are moved straight rearwardly. With this structure, at the final stage of the connection of the second connector 4 to the first connector 2, the swingable levers 5 will not be swingingly displaced, and the first connector 2 and the second connector 4 are slidingly displaced in unison along the support portions of the holder 1.

Therefore, even when a force, tending to disconnect the first and second connectors 2 and 4 from each other, is applied, so that each engagement pin 9 moves back and forth in the associated guide groove 10, any drive force to swingingly displace the swingable levers 5 will not be applied, and therefore the two connectors 2 and 4 are stably kept in the connected condition. And besides, within the range of the retaining groove portions 10*c*, the first connector 2, the second connector 4 and the slide members 5 move in unison back and forth relative to the holder 1, and therefore there is achieved an advantage that even if there is a small variation in the amount of pushing of the electronic unit 22, the two connectors 2 and 4 can be shifted into the connected position.

Figure 16:
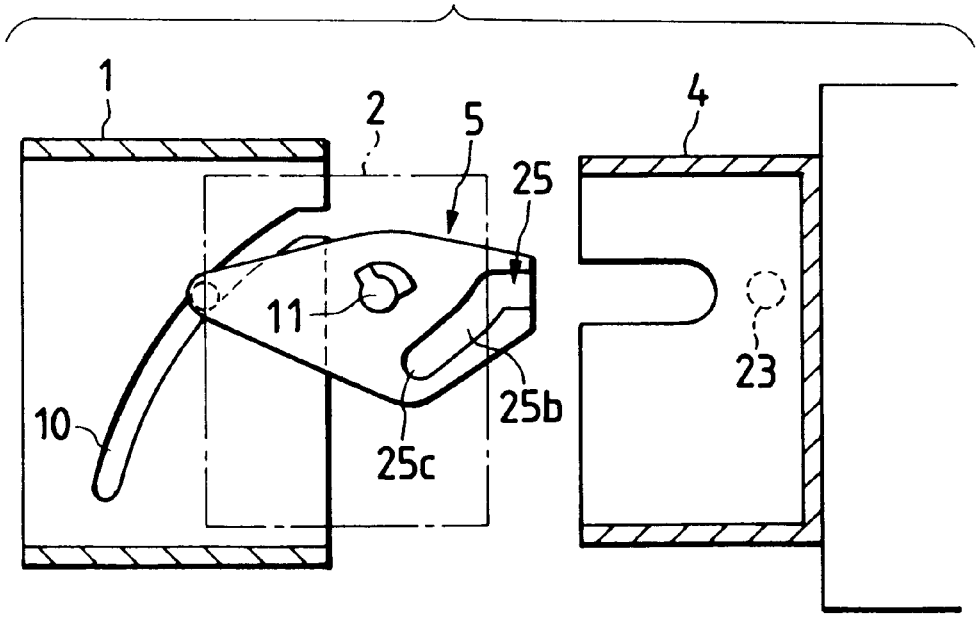
FIG. 16 is a cross-sectional view showing another embodiment of a connector connection structure of the invention.

Instead of the above structure in which each of the guide grooves 10 in the holder 1 has the retaining groove portion 10*c* so that at the final stage of the connection of the second connector 4 to the first connector 2, the first connector 2 and the second connector 4 can be slidingly displaced in unison in the holder 1, there may be provided a structure in which a retaining groove portion 25*c* of an arcuate shape, which is equidistant from the swing pivot 11 of the swingable lever 5 throughout its length, extends continuously from the operating groove portion 25*b* of the engagement groove 25, as shown in FIG. 16.

Figure 17A:
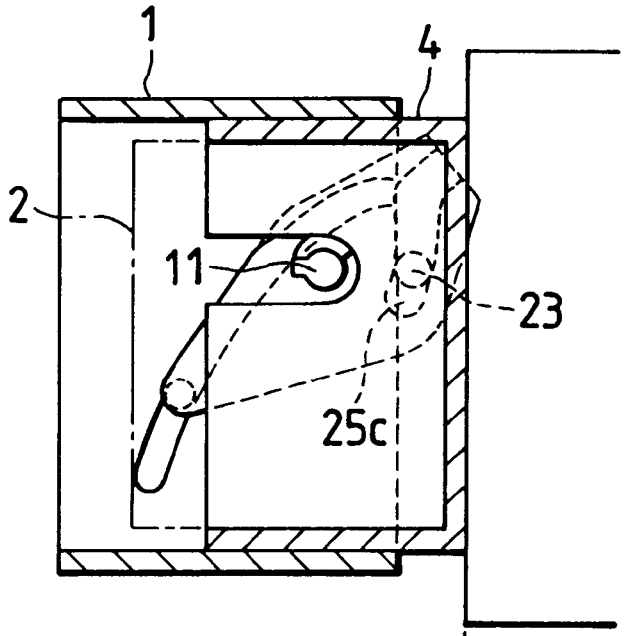
FIGS. 17A and FIG. 17B are explanatory views of the operation of the embodiment of FIG. 16.
Figure 17B:
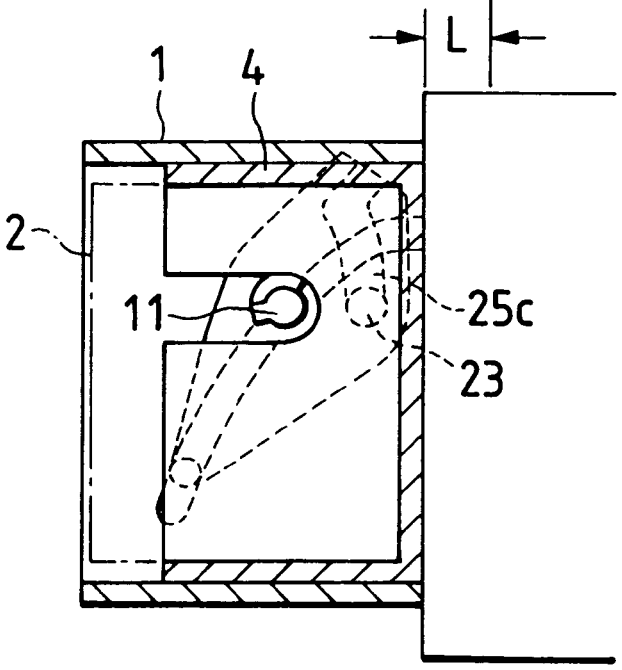

In this structure, when the second connector 4 is to be connected to the first connector 2, the swingable levers 5 are swingingly displaced in accordance with the sliding movement of the second connector 4, and then each driven pin 23, formed on the second connector 4, is introduced into the associated retaining groove portion 25*c* as shown in FIG. 17A, and in this condition even when each swingable lever 5 is further swingingly displaced, the first connector 2 and the second connector 4 are slidingly displaced in unison along the holder 1 since the distance between each driven pin 23 and the associated swing pivot 11 will not vary, as shown in FIG. 17B.

Therefore, the distance L between the position (FIG. 17A) where the driven pin 23 is introduced into the retaining groove portion 25*b* of the engagement groove 25 and the position (FIG. 17B) where the driven pin 23 reaches the end of the retaining groove portion 25*b* serves as a play for the connection of the second connector 4 to the first connector 2, and even if the push position at the final stage of the connection of the second connector 4 to the first connector 2 is displaced forwardly or rearwardly within the range of the distance L because of an manufacturing error of the connectors or the like, the two connectors 2 and 4 can be always shifted into the connected position.

Figure 18:
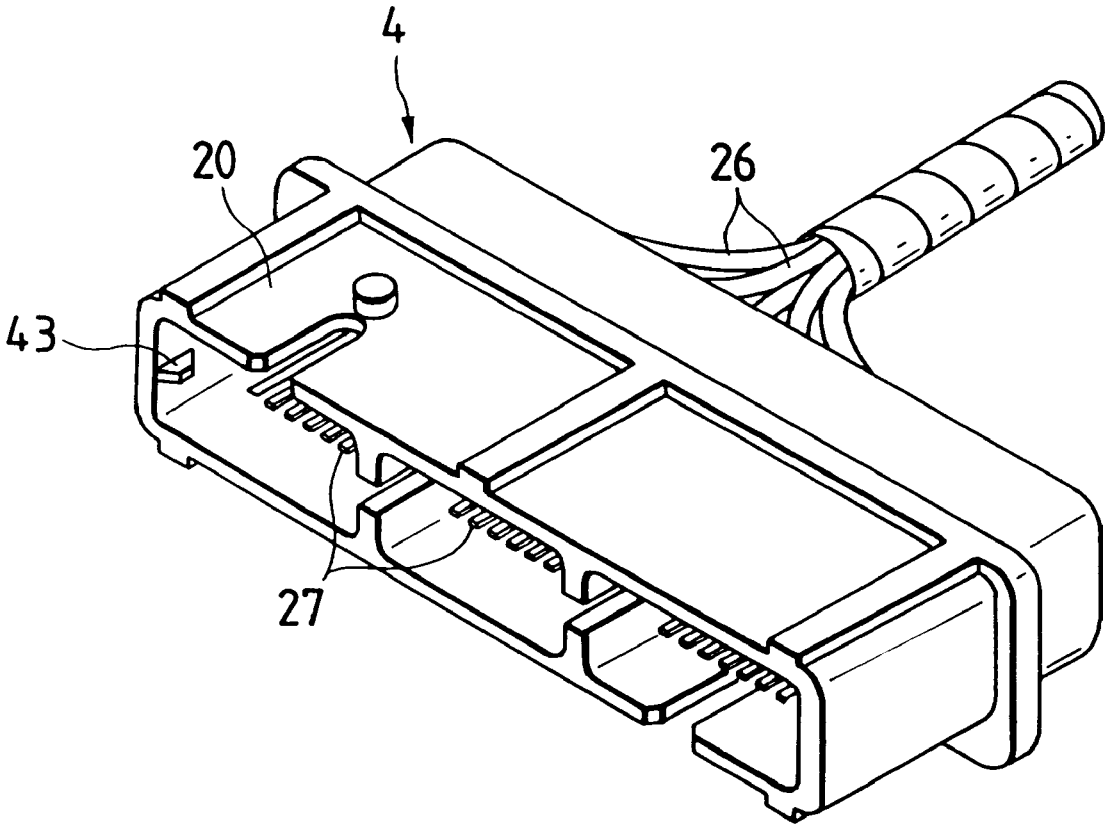
FIG. 18 is a perspective view showing a further embodiment of a connector connection structure of the invention.

It is not always necessary to mount the second connector 4 (which is to be connected to the first connector 2 supported on the mounting portion S) on the circuit board 3 provided in the electronic unit 22, but the connector housing of the second connector 4 may be formed integrally on a casing of an electric connection box or the like. Alternatively, as shown in FIG. 18, a second connector 4, comprising a female connector housing 20 and male terminals 27 connected at their rear ends to a harness 26, may be connected directly to the first connector 2. The holder 1 and the first connector 2 do not always need to be supported on the mounting portion S, but the holder 1 and the first connector 2, while held by the operator, may be connected directly to the second connector 4.

In the above embodiment, although the first connector 2, slidably supported by the holder 1, is mounted on the mounting portion S of the vehicle body while the second connector 4 to be connected to the first connector 2 is mounted on the electronic unit 22, the first connector 2, including the swingable levers 5 and the male connector housing 14, and the holder 1 may be mounted on the electronic unit 22, and the second connector 4, including the female connector housing 20, may be mounted on the mounting portion S. The holder 1 for supporting the first connector 2 may be molded integrally with a molded product such as an instrument panel or a trim cover of the automobile.

Instead of the above structure in which the engagement pins 9, formed respectively on the swingable levers 5, are introduced into and engaged in the respective guide grooves 10 formed in the holder 1, there may be provided a structure in which the engagement pins 9 are formed on the holder 1, and the guide grooves 10, in which the engagement pins 9 are engageable, respectively, are formed in the swingable levers 5, respectively. The swingable levers 5 may be swingably supported on the holder 1, and the drive groove portions 10*b*, forming the drive portions for swingingly displacing the swingable levers 5, or the engagement pins 9 may be provided at the connector housing 14 of the first connector 2. Instead of the swingable levers 5, there may be used operating members (as disclosed in Japanese Patent Unexamined Publication No. 4-319271) having a cam groove, by which the two connectors 2 and 4 are connected together.

As describe above, in the invention, the drive mechanism for moving the first connector to the pre-connection position when releasing the connection between the first and second connectors is provided on the first and second connectors, and the second connector is provided with the retaining portions which maintain the connection between the first connector and the second connector, achieved by the drive mechanism, before the first connector is moved to the pre-connection position by the drive mechanism, and also allow the first connector to be released from the second connector when the first connector is moved to the pre-connection position. Therefore, even if an external force, limiting the movement of the first connector, is applied during the time when the first connector is moved toward the front side of the holder, and is moved to the pre-connection position by the drive mechanism, the retaining portions prevent the disengagement of the second connector before the first connector before the first connector is returned to the pre-connection position, and when releasing the connection between the two connectors, the first connector can be positively moved to the pre-connection position by the drive mechanism.

In the connector connection structure of the invention, there is provided the release mechanism which when connecting the first and second connectors together, drives the retention mechanism so as to forcibly release the pre-connection position of the first connector. Therefore, before the two connectors are connected together, the first connector can be temporarily maintained in the pre-connection position, and also when connecting the two connectors together, the pre-connection position of the first connector, can be easily and positively released, so that the first connector can be shifted into the connected condition.

What is claimed is:

1. An electrical connector connection structure comprising:

a first connector held in a holder for movement between a first position and a second position in the holder;

a second connector for connection to said first connector;

a retention mechanism provided on said first connector and said holder for temporarily holding said first connector in the holder in a pre-connection position which is the first position, wherein when connecting said first and second connectors together, said first connector is released from the first position, so that said first connector is slidingly shifted in said holder from the first position into a final connection position which is the second position in the holder;

a drive mechanism provided on said first and second connectors for connecting and releasing the first and second connectors and for moving, said first connector from the second position in the holder to said first position in the holder when releasing the connection between said first and second connectors;

a retaining portion provided in said second connector, for maintaining the connection between the said first connector and the second connector, achieved by said drive mechanism, before said first connector is moved to said first position by said drive mechanism, and for allowing the connection between said first connector and said second connector to be released when said first connector is moved to said first position; and a release mechanism, which when connecting said first and second connectors together, drives said retention mechanism so as to forcibly release the first connector from the position in the holder.

2. The electrical connector connection structure according to claim 1, wherein said retention mechanism comprises a retaining arm projecting forwardly from a rear end portion of a side wall of said holder, and a step portion formed on an inner surface of a side wall of a connector housing of said first connector.

3. The electrical connector connection structure according to claim 2, wherein said retaining arm has a pair of upper and lower projections formed at a distal end, which abut against a rear end surface of said step portion to temporarily maintain said first connector in the first position.

4. The electrical connector connection structure according to claim 3, wherein said step portion has a inwardly slanting surface, when releasing the connection between the first and second connectors, said inwardly slanting surface abuts against a rear end of said upper and lower projections to swingingly displace said retaining arm inwardly.

5. The electrical connector connection structure according to claim 1, wherein said drive mechanism has a first engagement arm extending forwardly from a rear end portion of the first connector, a first engagement projection being formed at a distal end of the first engagement arm, and a second engagement arm extending forwardly from a rear end portion of the second connector, a second engagement projection for engagement with said first engagement projection being formed at a distal end of the second engagement arm.

6. The electrical connector connection structure according to claim 1, wherein said retention mechanism comprises a retaining arm projecting forwardly from a rear end portion of a side wall of said holder, and said retaining portion is formed on an inner surface of a side wall of a connector housing of the second connector, and when releasing the connection between the first and second connectors, swingingly displaces the distal end portion of the retaining arm inwardly.

7. An electrical connector connection structure comprising:

a first connector held in a holder for movement between a first position and a second position in the holder;

a second connector for connection to said first connector;

a retention mechanism provided on said first connector and said holder for temporarily holding said first connector in the holder in a pre-connection position which is the first position, wherein when the second connector is first connected to the first connector, the first connector is provisionally fixed in the holder and is not moved, and during inserting of the of the second connector into the holder the first connector is inserted into the holder with the second holder;

a drive mechanism provided on said first and second connectors for connecting and releasing the first and second connectors and for moving said first connector from a final connection position which is the second position in the holder to said first position in the holder when releasing the connection between said first and second connectors;

a retaining portion provided in said second connector, for maintaining the connection between the said first connector and the second connector, achieved by said drive mechanism, before said first connector is moved to said first position by said drive mechanism, and for allowing the connection between said first connector and said second connector to be released when said first connector is moved to said first position; and a release mechanism, which when connecting said first and second connectors together, drives said retention mechanism so as to forcibly release the first connector from the position in the holder.

8. An electrical connector connection structure comprising:

a first connector held in a holder for movement between a first position and a second position in the holder;

a second connector for connection to said first connector;

a retention mechanism provided on said first connector and said holder for temporarily holding said first connector in the holder in a pre-connection position which is the first position, wherein when connecting said first and second connectors together, said first connector is released from the first position, so that said first connector is slidingly shifted in said holder from the first position into a final connection position which is the second position in the holder;

a drive mechanism provided on said first and second connectors for connecting and releasing the thirst and second connectors and for moving said first connector from second position in the holder to said first position in the holder when releasing the connection between said first and second connectors;

a retaining portion provided in said second connector, for maintaining the connection between the said first connector and the second connector, achieved by said drive mechanism, before said first connector is moved to said first position by said drive mechanism, and for allowing the connection between said first connector and said second connector to be released when said first connector is moved to said first position, wherein during releasing of the second connector from the first connector, the first connector is not released from the second connector until the first connector is returned to the first position; and a release mechanism, which when connecting said first and second connectors together, drives said retention mechanism so as to forcibly release the first connector from the position in the holder.

9. An electrical connector connection structure comprising:

a first connector held in a holder for movement between a first position and a second position in the holder;

a second connector for connection to said first connector;

a retention mechanism provided on said first connector and said holder for temporarily holding said first connector in the holder in a pre-connection position which is the first position, wherein when the second connector is first connected to the first connector, the first connector is provisionally fixed in the holder and is not moved, and during inserting of the of the second connector into the holder the first connector is inserted into the holder with the second holder;

a drive mechanism provided on said first and second connectors for connecting and releasing the first and second connectors and for moving said first connector from a final connection position which is the second position in the holder to said first position in the holder when releasing the connection between said first and second connectors;

a retaining portion provided in said second connector, for maintaining the connection between the said first connector and the second connector, achieved by said drive mechanism, before said first connector is moved to said first position by said drive mechanism, and for allowing the connection between said first connector and said second connector to be released when said first connector is moved to said first position, wherein during releasing of the second connector from the first connector, the first connector is not released from the second connector until the first connector is returned to the first position; and a release mechanism, which when connecting said first and second connectors together, drives said retention mechanism so as to forcibly release the first connector from the position in the holder.

* * * * *